US005771581A

United States Patent [19]

Smith

[11] Patent Number: 5,771,581

[45] Date of Patent: Jun. 30, 1998

[54] CIGAR CAP-CUTTING AND EJECTION TOOL

[76] Inventor: Gerald K. Smith, 17575 Holiday Dr., Morgan Hill, Calif. 95037

[21] Appl. No.: 616,265

[22] Filed: Mar. 15, 1996

[51] Int. Cl.[6] ..... A24F 13/24

[52] U.S. Cl. ..... 30/111; 30/109; 131/255

[58] Field of Search ..... 30/109, 111, 113, 30/124, 142; 131/233, 248, 252, 253, 255

[56] References Cited

U.S. PATENT DOCUMENTS

| | | | |
|---|---|---|---|
| 376,511 | 1/1888 | Carter | 131/255 |
| 436,269 | 9/1890 | Scholer | 131/255 |
| 807,202 | 12/1905 | Pintz | 131/255 |
| 2,843,135 | 7/1958 | Lisiewski | 131/255 |
| 5,535,763 | 7/1996 | Conte | 131/255 |

*Primary Examiner*—Hwei-Siu Payer
*Attorney, Agent, or Firm*—John J. Leavitt

[57] ABSTRACT

Presented is a cigar cap-cutting and ejection tool provided with a very sharp circular cutting edge susceptible of being pressed into the cap-end of a cigar to thereby define the configuration of the central cigar cap-end portion to be cut from and withdrawn from the cigar by the tool. Plunger members are provided in the tool manipulable from the end opposite the circular cutting edge for ejecting the cut central cap-end portion of cigar from within the tool.

6 Claims, 1 Drawing Sheet

CIGAR CAP-CUTTING AND EJECTION TOOL

BACKGROUND OF THE INVENTION

1. Field of the Invention

The present invention relates to a tool for preparing a cigar for smoking, and particularly to a tool that removes the cap-end of a cigar without disturbing the area of the cigar surrounding the cap-end or the cigar filler material within the cigar.

2. Description of the Prior Art

The customary and conventional method of preparing a cigar for smoking has been to bite off the end of the cigar intended to be placed in the mouth, or cutting off the end of the cigar with the blade of a pocket knife or other sharp blade. In either case, the smoker is usually left with a frayed cigar end to place in the mouth, and possibly, in some cases, risking ingestion of the leafy tobacco material from the cigar. Connoisseurs of fine cigars smoke cigars, among other reasons, because they like the "feel" of the end of the cigar in the mouth. Having a frayed end of a cigar in the mouth lessens the pleasure derived from the "feel" sought by the cigar smoker. The conventional or customary methods described above are for that and other reasons unacceptable to the connoisseur of fine cigars.

Accordingly, one of the important objects of the present invention is to provide a tool to be used by the cigar smoker that will cleanly remove the central portion of a cigar-cap, leaving the remaining portion of the cigar-cap intact so as to prevent fraying of the leafy cigar wrapper.

Another object of the invention is the provision of a tool that is compact and unobtrusive so that it may conveniently be carried in a pocket.

Still another object of the invention is the provision of a tool equipped with a sharp circular cutting edge that easily and smoothly penetrates the central portion of the cap-end of the cigar without disturbing the surrounding area.

Yet another object of the invention is the provision of a tool that not only cuts and extracts a centrally located portion from the cap-end of the cigar, but which may be easily manipulated to expel from the tool the extracted portion of cigar.

A still further object of the invention is the provision of a cigar cutting tool having a recess with sharpened edges for cutting into the cap-end of the cigar, and which includes means for conveniently ejecting from the tool the portion of the cigar cut therefrom.

A still further object of the invention is the provision of a tool of the type herein described which is fabricated from durable material that effectively withstands innumerable cigar cap cutting operations without need of resharpening.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the cigar cutting tool of the invention comprises a generally cylindrical housing tube one end of which is provided with a very sharp circular cutting edge susceptible of being pressed into the cap-end of a cigar to thereby define the configuration of the central cigar portion to be cut from and withdrawn from the cigar by the housing tube. Plunger means are provided within the housing tube, manipulable from the end opposite the circular cutting edge for ejecting the cut central portion of cigar from within the housing tube.

DESCRIPTION OF THE PREFERRED EMBODIMENT

Figure 1:
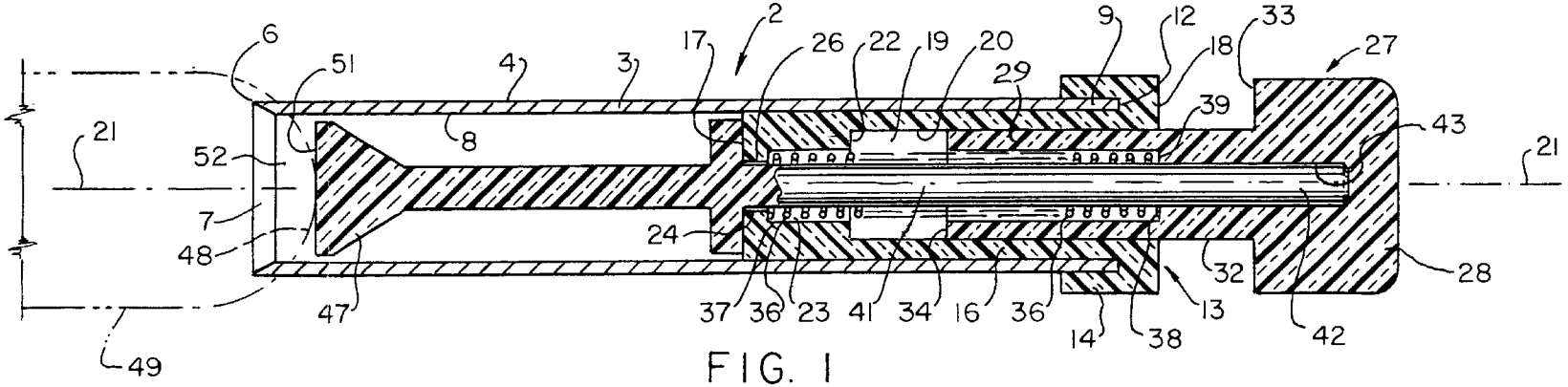
FIG. 1 is a horizontal cross-sectional view of the tool, shown approximately two and one-half times actual size, taken along its longitudinal axis, and shown with the circular cutting edge in penetrating position in relation to the cap-end of the cigar, and with the plunger retracted.

In terms of greater detail, the tool forming the subject of the present invention is designated generally by the numeral 2, and comprises an outer metallic tubular housing portion designated generally by the numeral 3. Because the tool is intended to be carried in a pocket so as to be readily available, and because when in use it is visible to observation by others, and further because the tool will frequently be handled by fingers that may be wet with perspiration, the tubular housing is preferalby fabricated from stainless steel of sufficient thickness as to not crush easily, or be damaged by other articles carried in the pocket such as keys or a pocket knife, and the outer surface 4 of the tubular housing is preferably polished to a mirror-finish.

As illustrated in the drawings, the circular sharpened end edge 6 defines the full diameter of the tubular housing, and is formed by grinding and/or honing the interior end surface portion 7 into a conical configuration that tapers outwardly from the inner peripheral surface 8 of the tubular housing. At its opposite end, the tubular housing is provided with a mounting portion 9 terminating in end edge 12. The mounting portion 9, as shown, is fixedly embedded in a cylindrical bearing insert designated generally by the numeral 13, including an exterior flange portion 14 that is press-fitted or otherwise fixed permanently in overlapping relationship onto the exterior end surface portion of the mounting portion 9 of the tubular housing.

The exterior flange portion 14 of the bearing insert 13 is integral with a cylindrical elongated interior plug portion 16 that is conveniently press-fitted into the open end of the tubular housing, conforms to inner surface 8 thereof, and extends into the tubular housing just short of half the length of the tubular housing to provide an end surface 17 that functions as a stop or abutment for a purpose which will hereinafter be explained. In like manner, the opposite end surface 18 of the bearing insert 13 functions as a stop or abutment in a manner and for a purpose hereinafter explained. The bearing insert 13 is preferably fabricated from an appropriate synthetic resinous material, either by machining, or by injection molding.

Interiorly, the bearing insert 13 is provided with a first bore or cavity 19 defined by a cylindrical surface 20 that is symmetrical about the longitudinal axis 21 of the tool, and which is concentrically related to the inner periphery 8 of the tubular housing 3. At its outer end the first bore 19 and surface 20 are intercepted by the end surface 18, while at its opposite end the first bore 19 and surface 20 are intercepted by a first annular shoulder 22 that extends transversely of the longitudinal axis to be intercepted by the inner periphery of a second bore 23 of smaller diameter than the first bore 19. The second bore 23 extends axially toward the sharpened end edge 6, and terminates in a second annular shoulder 24 that also extends transversely of the longitudinal axis, and which is itself intercepted by the third bore 26 formed in the bearing insert. The third bore 26 is defined at one end by the transverse annular shoulder 24 and at its other end by the stop or abutment surface 17.

While I have described the bearing insert 13 as being press-fitted onto the tubular housing 3, it should be understood that the interengagement of the tubular housing 3 and bearing insert 13 may also be effected by a snug fit between these parts, with an appropriate adhesive applied to retain the parts permanently attached one to the other.

Slidably mounted within the bore 19 of the bearing insert 13, more specifically slidably disposed on and in relation to the surface 20 of bore 19, there is provided a plunger designated generally by the numeral 27. The plunger is preferably fabricated from a suitable synthetic resinous material, such as those sold under the trademarks "Teflon" or "Delrin", and includes a head portion 28, formed integrally by machining or by injection molding, with a cylindrical guide portion 29 having a cylindrical cavity 30 therein concentrically disposed in relation to the central axis and defined by the inner peripheral wall surface 31, and a cylindrical outer bearing surface 32 that is slidably disposed in relation to the inner peripheral surface 20 of the bearing insert 13.

Figure 2:
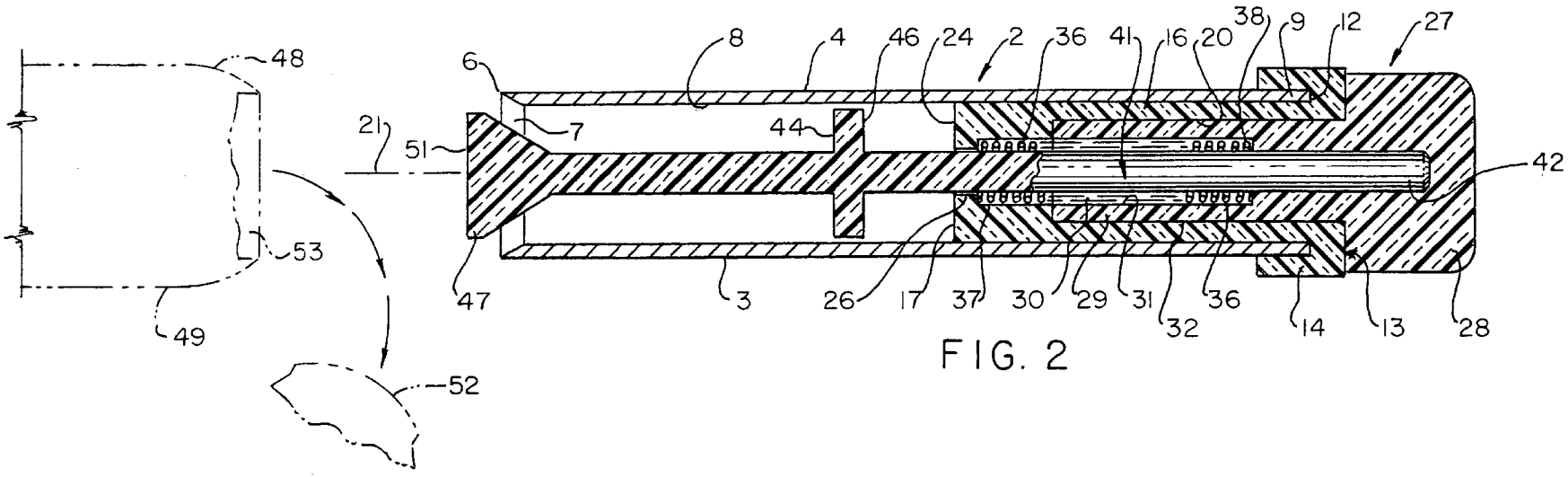
FIG. 2 is a horizontal cross-sectional view similar to FIG. 1, but illustrating the sharp circular cutting edge of the tool removed from the associated end of a cigar and the plunger deployed to eject the cut portion of the cigar from the tool.

As illustrated in the drawings, the head portion 28 is provided with an under surface 33 that functions as a stop or abutment as will hereinafter be described. Additionally, the length of the guide portion 29 of the plunger 27 is dimensioned so that when the plunger 27 is fully deployed as illustrated in FIG. 2, the under surface 33 of the head portion 28 abuts against the end surface 18 of the bearing insert 13, while the interior end surface 34 of the plunger guide portion 29 abuts against the first annular shoulder 22. The outer cylindrical bearing surface 32 of the plunger 27 slidably guides on the inner peripheral surface 20 of the bearing insert 13. Thus axial displacement of the plunger 27 in the direction of deployment is limited by both abutment surfaces 18 and 22.

Mounted within the cavities or bores 23 and 30 is a coil compression spring 36. The spring at one end 37 bears against the annular transverse shoulder 24, while at its opposite end 38 the spring 36 abuts against the annular transverse shoulder 39 that defines one end of the bore or cavity 30. The length of the spring and the axial dimensions of the cavities 23 and 30 are such that when the plunger 27 is in its retracted position as illustrated in FIG. 1, the spring 36 is only slightly compressed so as to continually exert a resilient biasing force on the plunger 27, tending to push it out of the open end of the bearing insert 13.

To prevent the plunger 27 from being pushed out of the bearing insert 13, and to provide a means of ejecting from the tubular housing 3 the cut portion of the cigar, there is mounted on the plunger 27 an elongated ejection and stop rod designated generally by the numeral 41. The ejection and stop rod 41 is preferably fabricated from the same material as the bearing insert 13 and plunger 27. One end portion 42 of the rod 41 is embedded in the plunger guide portion 29 beyond the shoulder 39 and continues into the head 28 where it is secured either by press-fitting into an appropriate bore 43 that receives the end portion or is adhesively permanently secured therein.

Intermediate the ends of the ejection/stop rod 41 there is provided an integral annular abutment 44 that is positioned along the length of the ejection/stop rod 41 so that its annular transverse side surface 46 lies parallel with the end surface 17 of the bearing insert 13. When the spring 36 normally resiliently biases the plunger 27 into its retracted position as illustrated in FIG. 1, the transverse annular surface 46 comes into abutting contact with the end surface 17, thus limiting the axial translation of the plunger 27 to the right as seen in FIG. 1.

In this retracted position of the plunger, the ejection head 47, which is formed integrally on the end of the axially aligned ejection/stop rod 41 remote from the head portion 28 of the plunger, lies within the interior of the outer metallic housing portion 3, spaced sufficiently from the sharpened end edge 6 to enable penetration of the end edge 6 into the cap end 48 of the cigar 49 shown in broken lines in the drawings. Penetration is effected by grasping the cigar with the fingers of one hand, say the left hand, while grasping the tool in the fingers of the right hand, aligning the axis of the tool with the long axis of the cigar, and placing the sharpened circular end edge 6 against the cap end 48 of the cigar 49 while pressing the tool into the cigar with a slight rotational movement.

The sharpened circular end edge 6 of the tool will cut cleanly through the cap leaf of tobacco, and penetrate the cigar until the end of the cigar abuts the outer face 51 of the ejection head 47. At this point, all that is required to detach the cigar cap end portion 52 from the remainder of the cigar is that a slight laterally reciprocating displacement be effected to the opposite end of the tool, whereupon the filler tobacco within the cap end of the cigar is broken away, leaving the now detached cap end portion 52 within the end of the tubular metallic housing portion 3, and leaving a recess 53 in the end of the cigar that permits smoke to be easily and conveniently drawn through the cigar from the lighted end thereof.

To eject the detached cap end portion 52 from within the tubular metallic housing, the head 28 of the plunger is depressed against the resilient bias of the spring 36 while holding the tubular metallic housing portion 3 stationary. This causes the ejection head 47 to be displaced to the left as viewed in FIG. 2, driving the detached cap end portion 52 out of the tool housing as illustrated in FIG. 2.

Having thus described the invention, what is believed to be new and novel and sought to be protected by letters patent of the United States is as follows.

I claim:

1. A cigar cap-cutting and cap extraction tool, comprising:

a) a housing one end of which is provided with a sharp cutting edge adapted to cut into the cap-end of a cigar when pressed thereagainst to sever therefrom a cap-end portion which remains temporarily within said housing adjacent said cutting edge; and b) a resiliently biased plunger axially translatably mounted on said housing normally in a retracted position and having a cap-end ejection head on one end normally retracted within said sharp cutting edge when said cutting edge is pressed into the cap-end of said cigar, said plunger being selectively manipulable to cause said ejection head to expel said cut cap-end portion of the cigar from said housing.

2. The cigar cap-cutting and cap extraction tool according to claim 1, wherein said housing is cylindrically tubular and symmetrical about a longitudinal axis, and said sharp cutting edge is circularly disposed about said axis.

3. The cigar cap-cutting and cap extraction tool according to claim 1, wherein said housing includes an elongated cylindrical tubular metal portion, said cutting edge is formed on one end of said tubular metal portion, an elongated plug portion mounted on the end of said tubular metal portion remote from said cutting edge, and said resiliently biased plunger is slidably mounted on said elongated plug portion.

4. The cigar cap-cutting and cap extraction tool according to claim 3, wherein said elongated plug portion is tubular and includes a slide bearing portion to slidably guide axial translation of said plunger, and opposite end portions of said elongated plug portion include abutment surfaces to limit axial translation of said plunger in both the extended ejection and retracted positions.

5. The cigar cap-cutting and cap extraction tool according to claim 4, wherein said elongated plug portion is tubular and includes a cylindrical recess symmetrical about said longitudinal axis defined by an inner peripheral surface interrupted by oppositely extending annular shoulders, said plunger includes a cylindrical recess open at one end and having a transverse shoulder at its opposite end and an ejection/stop rod extending axially through said cylindrical recesses of said plug portion and said plunger and extending to adjacent said sharp cutting edge, an abutment on said ejection/stop rod adapted to abut the associated end of said elongated plug portion when said plunger is retracted, said ejection head on said ejection/stop rod associated with said sharp cutting edge lying within said housing when said plunger is retracted, and a coil compression spring having one of its ends abutting one of said annular shoulders of said plug portion and having its other end abutting the transverse shoulder in said plunger, whereby said plunger is resiliently biased in a retracted direction.

6. The cigar cap-cutting and cap extraction tool according to claim 3, wherein said plunger includes a head portion having an abutment surface at each opposite end effective to engage complementary abutment surfaces on said elongated plug portion when said plunger is translated in a direction to eject said cap-end portion of the cigar from said housing.

* * * * *